United States Patent [19]

Benzon-Petersen

[11] 3,985,291

[45] Oct. 12, 1976

[54] CARRYING BAG

[75] Inventor: Boye Benzon-Petersen, Lund, Sweden

[73] Assignee: AB Akerlund & Rausing, Lund, Sweden

[22] Filed: June 27, 1975

[21] Appl. No.: 590,911

Related U.S. Application Data

[62] Division of Ser. No. 405,008, Oct. 10, 1973, abandoned.

[52] U.S. Cl. ..... 229/54 R; 150/1.7; 206/801

[51] Int. Cl.[2] ..... B65D 33/10

[58] Field of Search ..... 229/54 R, 54 C, 69; 206/526, 801; 150/1.7, 12; 93/93 HT

[56] References Cited

UNITED STATES PATENTS

| | | | |
|---|---|---|---|
| 3,669,254 | 6/1972 | Chrysanthis et al. | 206/526 |

FOREIGN PATENTS OR APPLICATIONS

| | | | |
|---|---|---|---|
| 621,737 | 6/1961 | Canada | 229/54 R |
| 911,790 | 10/1972 | Canada | 229/54 R |

*Primary Examiner*—Stephen P. Garbe
*Attorney, Agent, or Firm*—Pierce, Scheffler & Parker

[57] ABSTRACT

In an improved tote, having a body, a bottom and two handles attached to the body, one of the handles is arranged to project outwardly from the mouth of the tote while the other handle is folded inwardly against the body part.

3 Claims, 10 Drawing Figures

CARRYING BAG

This is a division of application Ser. No. 405,008 filed Oct. 10, 1973, now abandoned.

The present invention relates at first hand to a carying bag, including a body part provided with a bottom and two handles attached to said body part, and specially adapted to be handled in a bag erecting apparatus.

In self-service-shops, supermarkets, and similar shops the filling of the carrying bags provides at the check out an essential obstacle, which obstructs the flow through the check out. Normally, the bags are filled by the customers who seldom are able to work as rapidly as the cashier. Different attempts have therefor been made in order to provide an apparatus for automatic erecting and filling of the bags. Those attempts have not up to now led to any success, probably, because the bags have not been adapted to the different systems.

The present invention provides on the other hand a carrying bag specially adapted to be handled in a bag erecting apparatus. Said bag is characterized in that one handle as known per se is arranged projecting outwardly from the mouth of the bag, while the other handle is folded inwardly against the body part of the bag. Thanks to this arrangement the outwardly projecting handle may in a simple manner be used for separating a bag from a plurality in a magazine.

The invention relates also to an apparatus for erecting carrying bags of the kind defined above. Said apparatus includes a magazine for empty flat folded bags and is characterized by means for holding the handle projecting outwardly from the mouth of the bag and clutching means for clutching and moving an other part of the bag while the bag at the same time is being erected.

Preferably said clutching means is adapted to clutch a bottom fold of the bag and to move said fold to a position in which the bottom of the bag is positioned perpendicular to the tubular body part of the bag, at the same time as said tubular body part at least partly is brought to an expanded condition compared with its originally flat folded condition.

Preferably, the apparatus according to the invention also includes means for a complete expansion of the bag and for moving said bag from the erecting position to a filling position.

The invention is described more in detail in the following referring to the attached drawings, which schematically show a prototype of a preferred embodiment of the apparatus according to the invention and with carrying bags arranged in the apparatus. Even if the drawings show a prototype, which is intended to be handled more or less manually, it should be clear to a man skilled in the art, that the apparatus of course also may be arranged for erecting of the bags completely automatically or partly automatically.

Figure 9:
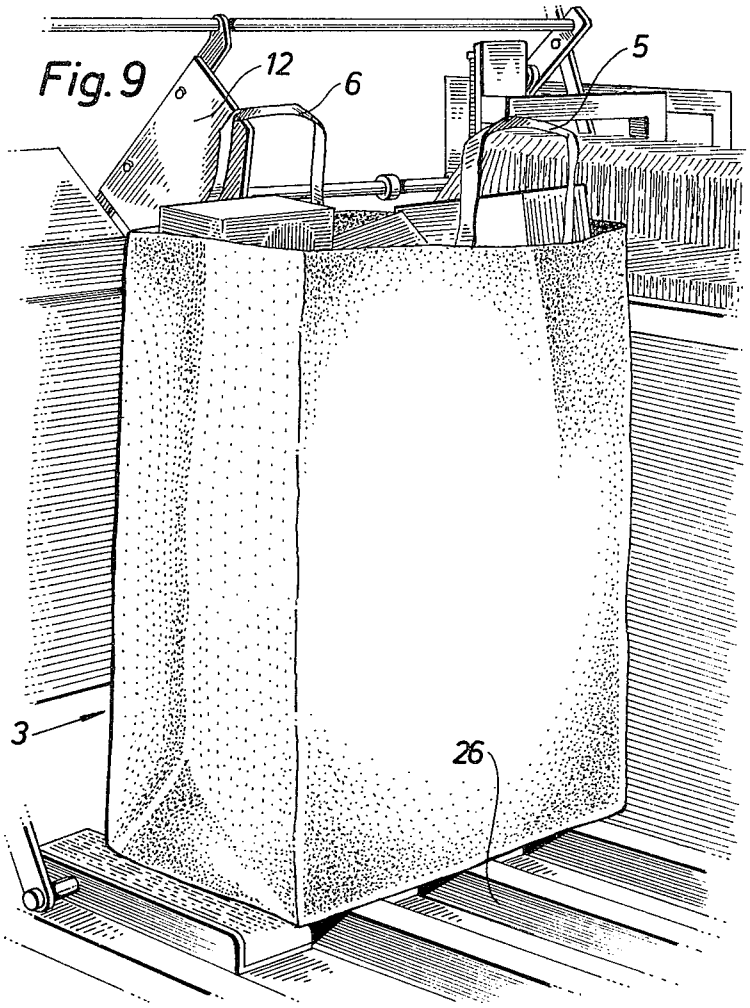

FIG. 9 finally shows the filled bag brought down onto a conveying belt or the like by means of which it might be transferred away in order to give place for a an empty bag.

Figure 1:
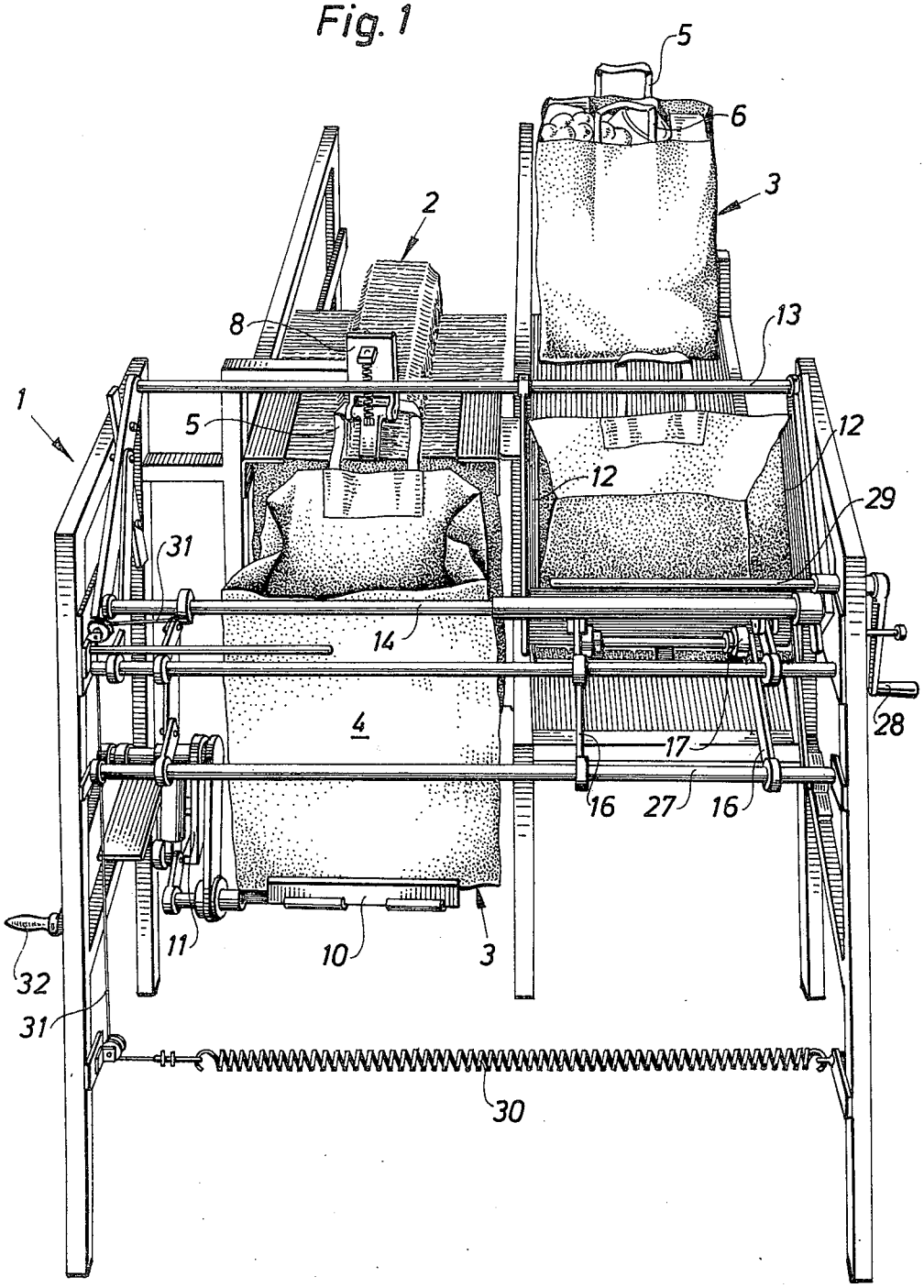
FIG. 1 shows the prototype in perspective as which is intended to be placed close to the end of a conventional check out instead of the packing table, packing-band or similar devices, which otherwise normally are situated at that place.
Figure 7:
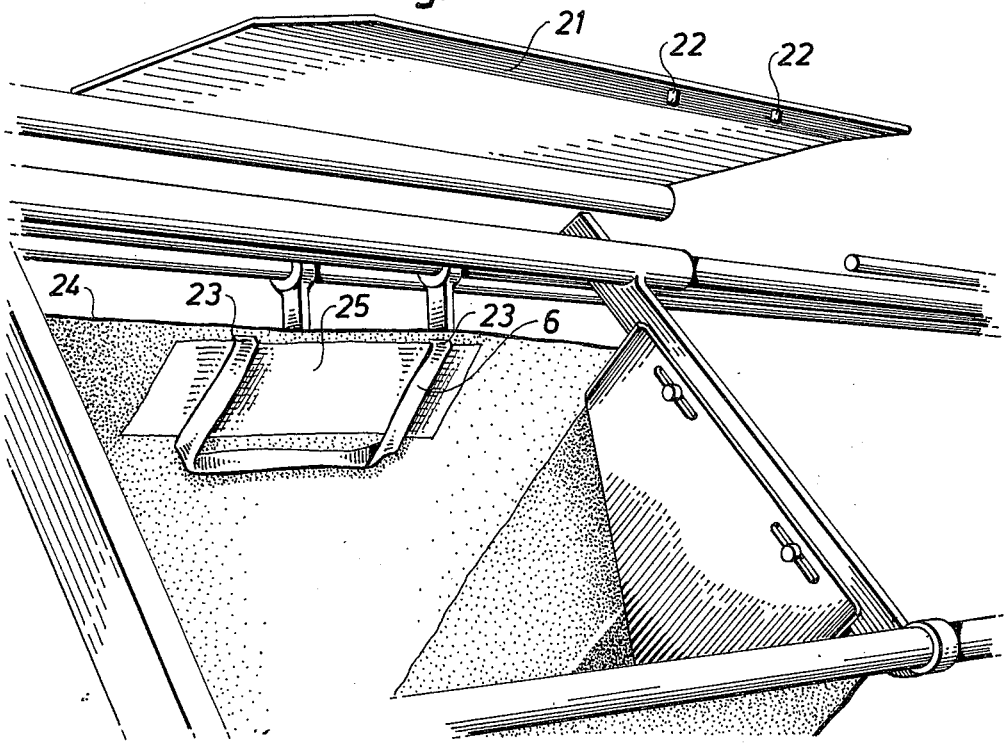
FIG. 7 shows a carrying bag in the filling position together with a projection plate, which is intended to be turned down into the carrying bag.

As may be best seen from FIG. 1 the shown prototype apparatus is built on a tubular support 1. The apparatus includes a magazine 2 for empty flat folded carrying bags. Those bags are specially adapted to be handled in the bag erecting apparatus in that one handle of each bag is folded into the body part of the bag. The carrying bag has in the drawing been marked 3, while the body part proper has been marked 4, the projection handle 5, and the inwardly folded handle 6. The last mentioned handle is best shown in FIG. 7.

Figure 2A:
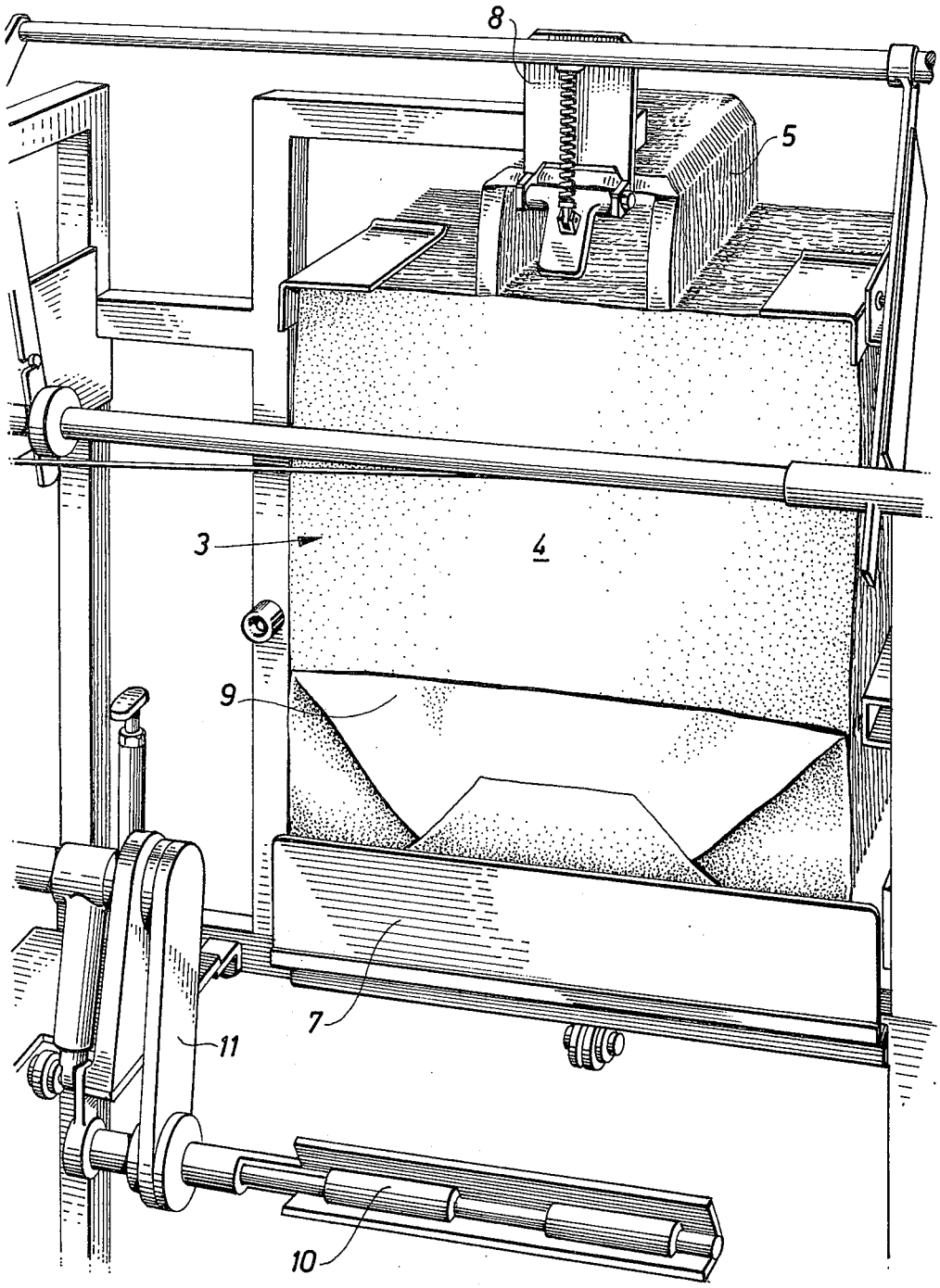
FIG. 2A shows an end view of the magazine of the apparatus with flat folded carying bags placed therein.

As may be best seen from FIG. 2A the flat folded empty bags are kept pressed by means not shown, a spring loaded feeding plate for instance, against the bottom plate 7 and a handle stop 8. The bags are provided with a bottom fold 9, which is adapted to be clutched by clutching means 10. Said clutching means 10 is brought by means of a linkage 11 from the position shown in FIG. 2 to the position shown in FIG. 3. In said last mentioned position the bottom fold 9 is clutched in order to be brought to the position shown in FIG. 1, in which position the flat bottom of the bag is brought to be perpendicular to the tubular body part 4 of the bag, at the same time as said tubular body part at least partly is brought to expand compared with its originally flat folded condition. During this entire erecting operation the handle 5 is kept in its position by the handle stop 8.

Figure 2B:
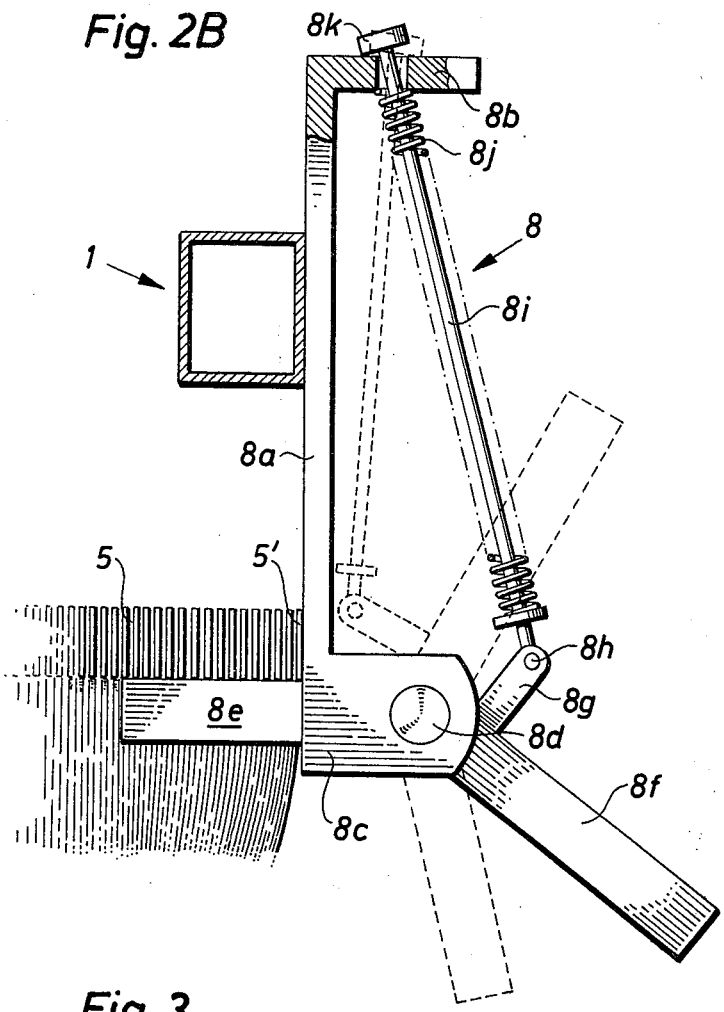
FIG. 2B shows a side view of a handle stop means included in the apparatus.
Figure 3:
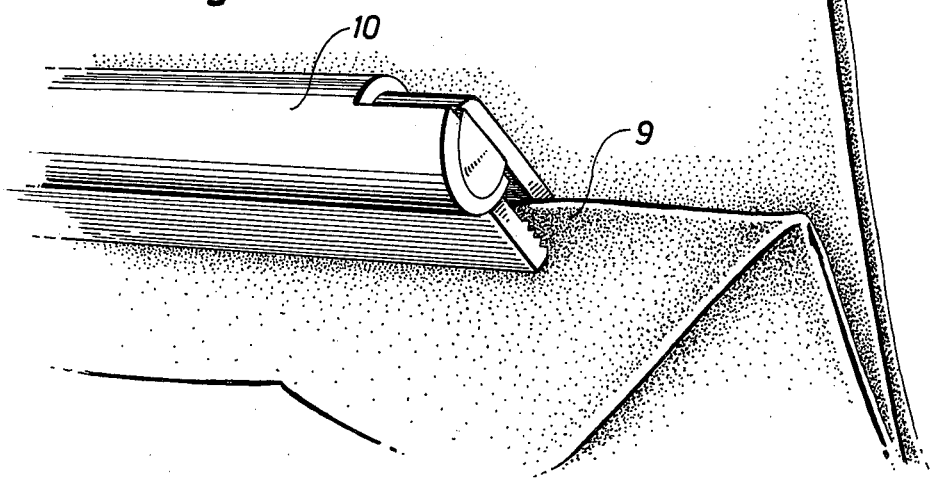
FIG. 3 shows a clutching means for clutching a bottom fold of the carrying bag in order to bring it to the position shown in FIG. 1.

This handle stop may be made in many different ways. In the prototype shown it has been given a simple manually operated construction, which best is shown in FIG. 2B. The handle stop shown includes a plate **8*a* with an upper shank 8*b* and two lower shanks 8*c*. Between the lower shanks 8*c* a shaft 8*d* is journalled. Said shaft carries a stop arm 8*e* and a control arm 8*f*. The control arm 8*f* carries an angle arm 8*g* provided with a bearing 8*h*. In the bearing 8*h* a rod 8*i* is journalled. Said rod carries a compression spring 8*j* and is at its upper end provided with a stop 8*k*. The location of the carrying bags is indicated only by means of the handles 5. By means of the control arm 8*f* the stop can be brought from the position shown by continuous lines to the position shown by the lines of short dashes. By said movement a dead-point is passed, so that the stop will remain in said last mentioned position. In said position a first handle 5' may easily be pulled free. The rest of the handles will remain pressed against the bottom part of the plate 8*a*. When the handle 5'** is free, the handle stop is returned to the position shown by continuous lines. Also this operation is carried out manually by the prototype shown. However, it may also naturally be automatically.

Figure 5:
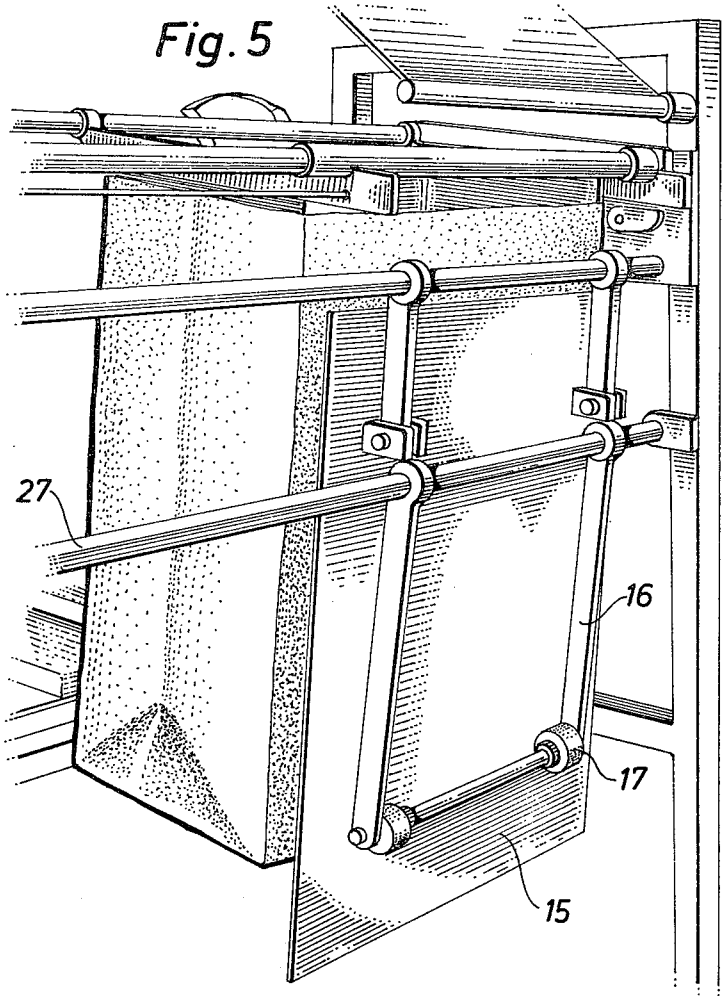
FIGS. 5 and 6 show the carrying bag moved from the erecting position shown in FIG. 1 to a filling position. Said filling position is situated to the right in FIG. 1.
Figure 4:
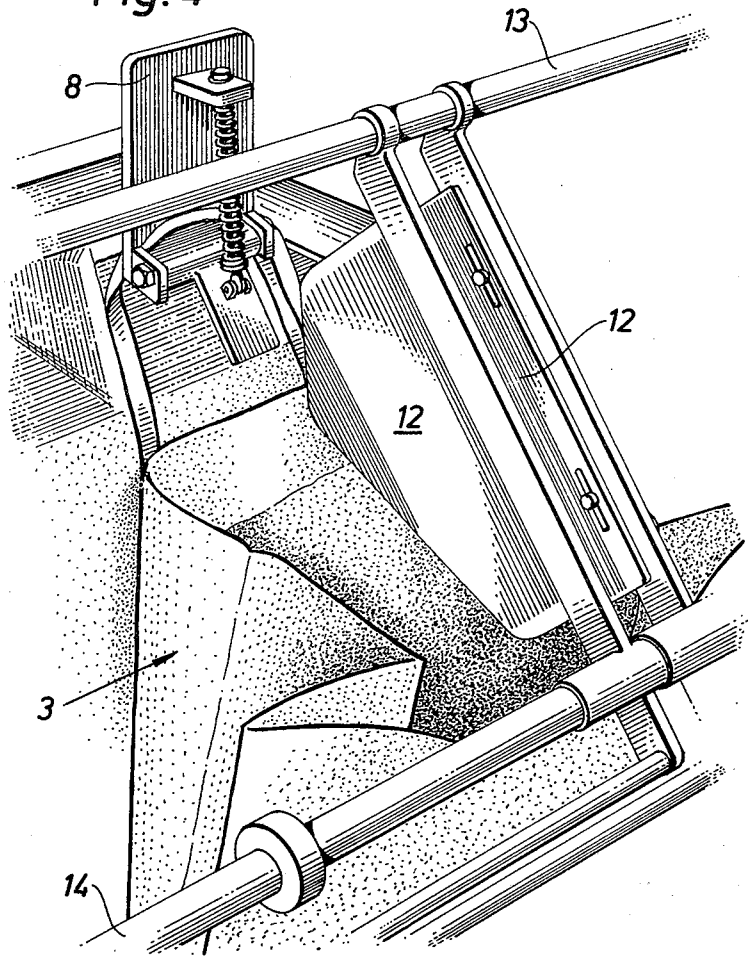
FIG. 4 shows a pair of carrier blades or expander means which are brought down into the bag in order to expand the mouth of the bag entirely.

FIG. 4 shows a pair of expander means such as carrier blades 12 adapted to be brought down into the partly erected bag. Those means are arranged slidably along transverse shafts 13 and 14. By means of the fact that the shaft 14 is pivotably mounted in the machine support the shaft 13 may be brought down against the partly erected bag 3 in such a way that the carriers blades 12 will project into the bag. In said position the carrier blades are moved in a direction from each other along the shafts 13 and 14. Due to this movement the mouth of the body part of the bag will be entirely opened. When said mouth is open the handle stop 8 releases its grasp of the handle 5. At the same time the clutching means 10 releases its grasp of the bottom fold 9. The carrying bag is thereafter held by means of only the carrier blades 12. By means of those blades the bag is thereafter moved to the position shown in FIG. 5. Said position corresponds to the right part of FIG. 1. In said position there is a support plate 15 which by means of pivotable arms 16 and rollers 17 may be turned from the essentially vertical position shown in FIG. 5 to an oblique position shown in FIG. 6, in which it supports one wall of the bag. Furthermore there is here a bottom support 18 (FIG. 8) which is intended to support the erected bottom of the bag. Said plate is in the example shown covered with foamed rubber or any similar chock absorbing material and may be turned by means of arms 20 around a shaft 20*a*.

Figure 6:
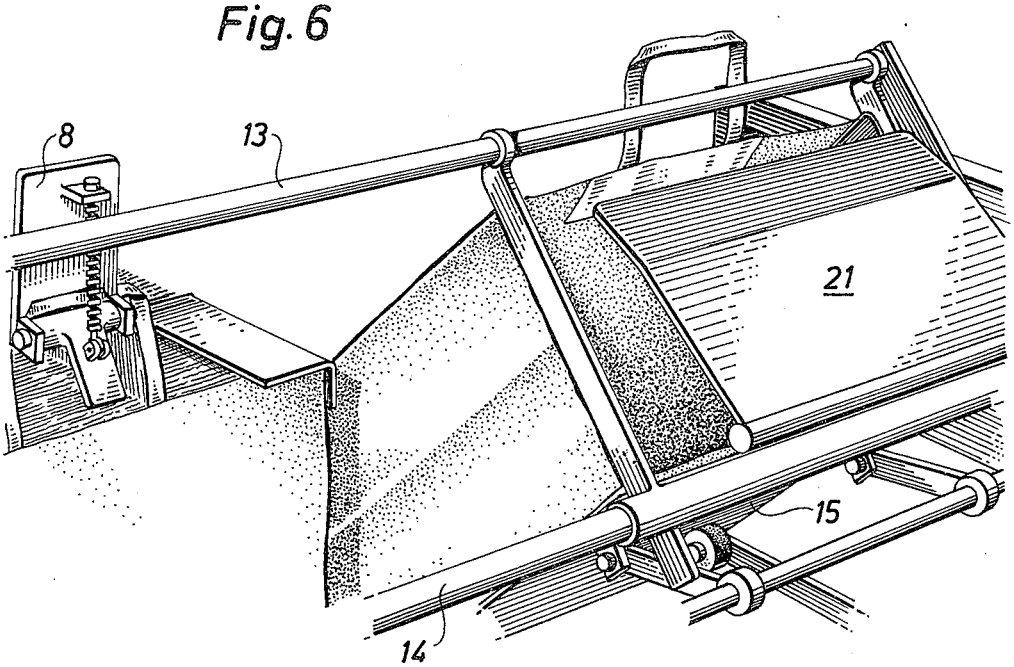

As may be best seen in FIG. 6 and 7 there is in the filling position also projection plate 21. Said plate is intended to be in the position shown in FIGS. 6 and 7 until a bag is correctly placed in the filling position. When a bag is placed in said position the plate 21 is turned into the bag and brought to cover the inwardly folded handle 6. At its lower side the projection plate 21 is provided with a pair of studs 22. The studs 22 are intended to catch the inwardly folded handle 6 when the bag after the filling is removed from the filling position. Due to this engagement with the handle, the bag will leave its filling position with the upwardly projecting handles as is shown in FIG. 9. In order to facilitate said folding upwardly of the handle it is provided with crease lines 23 close to the upper mouth edge 24 of the bag. Those crease lines 23 are situated just above the reinforcement paper 25, shown in FIG. 7, which encloses between itself and the material of the bag the free ends of the handle.

Figure 8:
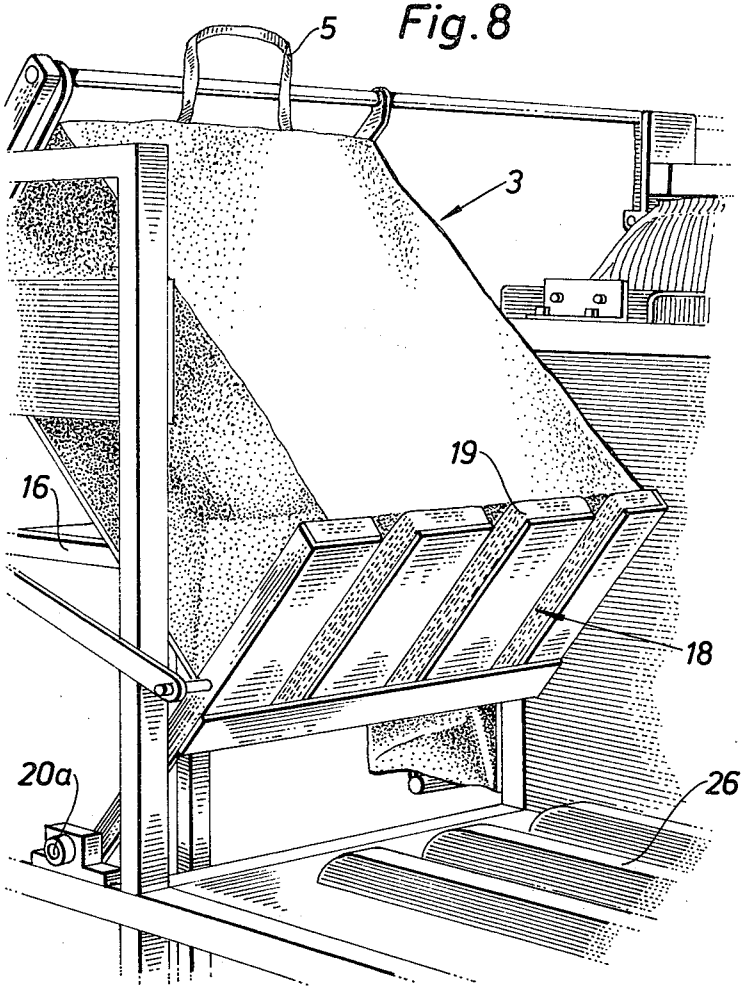
FIG. 8 shows the carrying bag in its filling position ready for filling.

In FIG. 8 and 9 a sliding plane is marked 26, by means of which the filled bag may be removed from the filling position. Said sliding plane may of course be replaced by a conventional conveying belt is desired.

The linkage 11 shown in FIG. 1 controls, by means of links, the clutching means 10. The shaft 13 and 14 and the carrier blades 12 arranged on said shafts and the pivotable arms 16 and 20 and thereby the support plate 15 and the support plate 18 are controlled manually, but may of course also be connected to the linkage 11. None of those linkages has been described in detail above, since it will be clear for a man skilled in the art that the movements of those details of course may be provided by means of other conventional means and therefor do not have any critical importance for the present invention.

The projection plate 21 is by the prototype shown controlled by means of a crank 28 and a shaft 29. Of course said movement may also be connected to the movement of the linkage 11 which also may be brought to perform further functions, such as the release of the handle stop 8, and the mutual movement of the carrier blades 12. However, neither of those details have any critical importance for the present invention and are therefor not described in detail.

A spring is marked 30 and a wire is marked 31. Those means are used by the prototype shown for moving the expander means or carrier plates 12 from the filling position back to the erecting position. The movement in the opposite direction is in the example shown made manually but may of course be made automatically be means of a simple driving mechanism.

The linkage 11 is in the example shown driven by means of a crank 32. Also this crank is however in practice intended to be replaced by an automatic driving mechanism, a programmed electrical motor for instance.

The invention is of course not restricted only to the above described embodiment, but may be varied within the scope of the following claims. For instance an automatic control of the apparatus will provide essential changes of many details. Such changes will however easily be made within the scope of the invention by means of conventional proceedings known by a man skilled in the art. Furthermore in the example shown one handle of the bag is folded inwardly into the bag. Of course the same result will be reached if the handle is folded outwardly against the outside of the bag.

I claim:

1. A plurality of carrying bags arranged in parallel stacked relation for subsequent withdrawal one by one from the stack, each bag having two opposed parallel side walls folded flat against each other and a bottom panel folded flat against the outside of one of the parallel side walls of the bag and having opposed handle members disposed centrally of the top of the opposed side walls, one handle member extending outwardly from the top of the bag and the other handle member being folded downwardly from the top of the bag, the downwardly folded handle member and the folded bottom panel of each bag of the plurality of bags being disposed in the same relative position with respect to each other.

2. A plurality of bags as claimed in claim 1 wherein said handle members are substantially U-shaped and further comprising means for securing the ends of each U-shaped handle respectively to the inside of each of said opposed parallel side walls.

3. A plurality of bags as claimed in claim 1 wherein the downwardly folded handle member is provided with a crease line adjacent the top of the opposed parallel side walls to facilitate lifting said handle member to an outwardly extended position for cooperation with said one outwardly extended handle member to facilitate lifting said bag.

* * * * *